US011018439B2

(12) United States Patent
Otsubo et al.

(10) Patent No.: US 11,018,439 B2
(45) Date of Patent: May 25, 2021

(54) SCANNED ANTENNA AND LIQUID CRYSTAL DEVICE

(71) Applicant: SHARP KABUSHIKI KAISHA, Sakai (JP)

(72) Inventors: Masashi Otsubo, Sakai (JP); Yoshinobu Hirayama, Sakai (JP); Akinori Kubota, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 276 days.

(21) Appl. No.: 16/180,576

(22) Filed: Nov. 5, 2018

(65) Prior Publication Data

US 2019/0140363 A1 May 9, 2019

(30) Foreign Application Priority Data

Nov. 6, 2017 (JP) ..... JP2017-213843

(51) Int. Cl.
*H01Q 1/36* (2006.01)
*H01Q 21/06* (2006.01)
(Continued)

(52) U.S. Cl.
CPC ..... *H01Q 21/065* (2013.01); *H01Q 1/36* (2013.01); *H01Q 1/364* (2013.01); *H01Q 3/44* (2013.01);
(Continued)

(58) Field of Classification Search
CPC .. H01Q 21/065; H01Q 1/364; H01Q 21/0006; H01Q 23/00; H01Q 21/064; H01Q 21/06; H01Q 1/36; H01Q 21/00
(Continued)

(56) References Cited

U.S. PATENT DOCUMENTS 7,466,269 B2 12/2008 Haziza
7,479,932 B2 * 1/2009 Tanaka ..... G09G 3/3666 345/1.1
(Continued)

FOREIGN PATENT DOCUMENTS

CN 1673820 A 9/2005
CN 101944346 A 1/2011
(Continued)

OTHER PUBLICATIONS

R. A. Stevenson et al., "Rethinking Wireless Communications: Advanced Antenna Design using LCD Technology", SID 2015 Digest, pp. 827-830.
(Continued)

*Primary Examiner* — Hai V Tran
(74) *Attorney, Agent, or Firm* — ScienBiziP, P.C.

(57) ABSTRACT

A scanned antenna according to an embodiment includes a plurality of first antenna elements and a plurality of second antenna elements. The first antenna elements are driven by a gate driver connected to a plurality of first gate bus lines and a first source driver connected to a plurality of first source bus lines. The second antenna elements are driven by a gate driver connected to a plurality of second gate bus lines and a second source driver connected to a plurality of second source bus lines. The gate driver and the gate driver operate independently of each other, and the first source driver and the second source driver operate independently of each other.

5 Claims, 9 Drawing Sheets

(51) Int. Cl.
*H01Q 21/00* (2006.01)
*H01Q 3/44* (2006.01)
*H01Q 23/00* (2006.01)

(52) U.S. Cl.
CPC ..... *H01Q 21/00* (2013.01); *H01Q 21/0006* (2013.01); *H01Q 21/06* (2013.01); *H01Q 21/064* (2013.01); *H01Q 23/00* (2013.01)

(58) Field of Classification Search
USPC ..... 343/853
See application file for complete search history.

(56) References Cited

U.S. PATENT DOCUMENTS

| | | | | |
|---|---|---|---|---|
| 7,847,894 | B2 | 12/2010 | Rho | |
| 2005/0179640 | A1 | 8/2005 | Tanaka et al. | |
| 2009/0289884 | A1* | 11/2009 | Yanagi | G09G 3/3677 345/92 |
| 2012/0092577 | A1 | 4/2012 | Shi et al. | |
| 2012/0194399 | A1 | 8/2012 | Bily et al. | |
| 2020/0050069 | A1* | 2/2020 | Yoshida | G02F 1/136209 |
| 2020/0168746 | A1* | 5/2020 | Otsubo | H01Q 3/443 |
| 2020/0328528 | A1* | 10/2020 | Misaki | H01Q 3/34 |

FOREIGN PATENT DOCUMENTS

| | | | |
|---|---|---|---|
| JP | 2002-217640 | A | 8/2002 |
| JP | 2007-116573 | A | 5/2007 |
| JP | 2007-295044 | A | 11/2007 |
| JP | 2009-538565 | A | 11/2009 |
| JP | 2013-539949 | A | 10/2013 |
| WO | 2007/139736 | A2 | 12/2007 |
| WO | 2012/050614 | A1 | 4/2012 |
| WO | 2014/149341 | A1 | 9/2014 |
| WO | 2015/126550 | A1 | 8/2015 |
| WO | 2015/126578 | A1 | 8/2015 |
| WO | 2016/057539 | A1 | 4/2016 |
| WO | 2016/130383 | A1 | 8/2016 |
| WO | 2016/141340 | A1 | 9/2016 |
| WO | 2016/141342 | A1 | 9/2016 |
| WO | 2017/061527 | A1 | 4/2017 |

OTHER PUBLICATIONS

M. Ando et al., "A Radial Line Slot Antenna for 12GHz Satellite TV Reception", IEEE Transactions of Antennas and Propagation, vol. AP-33, No. 12, pp. 1347-1353 (1985).

M. Wittek et al., "Liquid Crystals for Smart Antennas and Other Microwave Applications", SID 2015 Digestpp. 824-826.

Kuki, "New Functional Element Using Liquid Crystal" Polymer, vol. 55, August issue, pp. 599-602 (2006) (A concise explanation of the relevance can be found in paragraph [0039] of the specification of the subject application).

Co-pending letter regarding a related co-pending U.S. Appl. No. 15/542,488, filed Jul. 10, 2017.

* cited by examiner

SCANNED ANTENNA AND LIQUID CRYSTAL DEVICE

BACKGROUND

1. Technical Field

The present invention relates to a scanned antenna, and particularly to a scanned antenna (which may be referred to as a "liquid crystal array antenna") in which each antenna element (which may be referred to as an "element antenna") includes a liquid crystal capacitor. The present invention also relates to a liquid crystal device such as a liquid crystal display device.

2. Description of the Related Art

Antennas for mobile communication and satellite broadcasting applications need to have the capability of changing the beam direction (referred to as "beam scanning" or "beam steering"). As antennas having such a capability (hereinafter referred to as "scanned antennas"), phased array antennas including antenna elements have been known in the art. However, the high cost of conventional phased array antennas has been an obstacle for their widespread application to consumer products. Particularly, the cost increases significantly when the number of antenna elements increases.

In view of this, scanned antennas have been proposed in the art that utilize the high dielectric anisotropy (birefringence) of liquid crystal materials (including nematic liquid crystals and polymer-dispersed liquid crystals) (Japanese Laid-Open Patent Publication Nos. 2007-116573 and 2007-295044, Japanese National Phase PCT Laid-Open Publication Nos. 2009-538565 and 2013-539949, and International Publication WO2015/126550 pamphlet (hereinafter "Patent Document Nos. 1 to 5", respectively), and R. A. Stevenson et al., "Rethinking Wireless Communications: Advanced Antenna Design using LCD Technology", SID 2015 DIGEST, pp. 827-830 (hereinafter "Non-Patent Document No. 1")). The dielectric constant of a liquid crystal material has a frequency dispersion, and the dielectric constant in the microwave frequency band (which may be referred to as the "dielectric constant for microwaves") will be particularly designated as "dielectric constant M($\varepsilon_M$)" in the present specification.

Patent Document No. 3 and Non-Patent Document No. 1 state that an inexpensive scanned antenna can be realized by using technology for liquid crystal display devices (hereinafter referred to as "LCDs"). However, there has been no literature in the art that specifically describes the structure, the manufacturing method and the driving method of a scanned antenna using LCD technology.

The present applicant has developed a scanned antenna capable of being mass-produced by using conventional LCD manufacturing technology. International Publication WO2017/061527 pamphlet (hereinafter "Patent Document No. 6") by the present applicant discloses a scanned antenna capable of being mass-produced by using conventional LCD manufacturing technology, a TFT substrate for use in such a scanned antenna, a method for manufacturing such a scanned antenna and a method for driving such a scanned antenna. The entire content of Patent Document No. 6 is herein incorporated by reference.

SUMMARY

It is an object of the present invention to further improve the capacity of the scanned antenna described in Patent Document No. 6. It is another object of the present invention to improve the capacity of liquid crystal devices such as liquid crystal display devices, as well as scanned antennas.

A scanned antenna in one embodiment of the present invention is a scanned antenna including a plurality of antenna elements arranged in an array, the scanned antenna including: a TFT substrate including a first dielectric substrate, a plurality of TFTs supported on the first dielectric substrate, a plurality of gate bus lines, a plurality of source bus lines, and a plurality of patch electrodes; a slot substrate including a second dielectric substrate, a slot electrode formed on a first primary surface of the second dielectric substrate, wherein the slot electrode includes a plurality of slots arranged so as to correspond to the patch electrodes; a liquid crystal layer provided between the TFT substrate and the slot substrate; and a reflective conductive plate arranged so as to oppose a second primary surface of the second dielectric substrate opposite to the first primary surface with a dielectric layer therebetween, wherein: the antenna elements include first antenna elements and second antenna elements; the first antenna elements are driven by a first gate driver connected to a plurality of first gate bus lines and a first source driver connected to a plurality of first source bus lines; the second antenna elements are driven by a second gate driver connected to a plurality of second gate bus lines and a second source driver connected to a plurality of second source bus lines; and the first gate driver and the second gate driver operate independently of each other, and the first source driver and the second source driver operate independently of each other.

In one embodiment, the first gate driver and the first source driver drive the first antenna elements at a first driving frequency; and the second gate driver and the second source driver drive the second antenna elements at a second driving frequency that is different from the first driving frequency.

In one embodiment, the first antenna elements are for reception, and the second antenna elements are for transmission.

In one embodiment, the first antenna elements and the second antenna elements receive or transmit electromagnetic waves of different frequencies.

In one embodiment, a region where the first antenna elements are arranged and a region where the second antenna elements are arranged overlap each other.

A liquid crystal device in one embodiment is a liquid crystal device including a plurality of liquid crystal elements arranged in an array, wherein: each of the liquid crystal elements includes a first electrode, a second electrode, and a liquid crystal layer provided between the first electrode and the second electrode, wherein the first electrode is connected to a source bus line via a TFT, and the TFT is connected to a gate bus line; the liquid crystal elements include first liquid crystal elements and second liquid crystal elements; the TFT of each of the first liquid crystal elements is connected to a first source driver via a first source bus line; the TFT of each of the second liquid crystal elements is connected to a second source driver via a second source bus line; and the first source driver and the second source driver operate independently of each other.

A liquid crystal device in one embodiment is a liquid crystal device including a plurality of liquid crystal elements arranged in an array, wherein: each of the liquid crystal elements includes a first electrode, a second electrode, and a liquid crystal layer provided between the first electrode and the second electrode, wherein the first electrode is connected to a source bus line via a TFT, and the TFT is connected to a gate bus line; the liquid crystal elements include first liquid crystal elements and second liquid crystal elements; the TFT of each of the first liquid crystal elements is connected to a first gate driver via a first gate bus line; the TFT of each of the second liquid crystal elements is connected to a second gate driver via a second gate bus line; and the first gate driver and the second gate driver operate independently of each other.

According to an embodiment of the present invention, it is possible to further improve the capacity of a scanned antenna. According to another embodiment of the present invention, it is possible to further improve the capacity of a liquid crystal device such as a liquid crystal display device.

DETAILED DESCRIPTION

[Basic Structure of Scanned Antenna]

With a scanned antenna using antenna elements that utilize the significant dielectric constant M($\varepsilon_M$) anisotropy (birefringence) of the liquid crystal material, the voltage to be applied across the liquid crystal layer from each of the antenna elements associated with the pixels of the LCD panel is controlled so as to vary the effective dielectric constant M($\varepsilon_M$) of the liquid crystal layer of the various antenna elements, thereby forming a two-dimensional pattern with antenna elements of different static capacitances (corresponding to displaying an image on an LCD). The electromagnetic wave (e.g., microwave) emitted from, or received by, an antenna is given a phase difference depending on the static capacitance of the antenna element, thus realizing a strong directionality toward a particular direction depending on the two-dimensional pattern formed by antenna elements of different static capacitances (beam scanning). For example, the electromagnetic wave emitted from the antenna can be obtained by integrating together spherical waves that are obtained as the input electromagnetic wave is incident upon antenna elements to be scattered by the antenna elements, taking into consideration the phase differences given by the antenna elements. It may be considered that each antenna element is functioning as a "phase shifter". For the basic structure and the operation principle of a scanned antenna using a liquid crystal material, refer to Patent Document Nos. 1 to 4, Non-Patent Document No. 1 and M. ANDO et al., "A Radial Line Slot Antenna for 12 GHz Satellite TV Reception", IEEE Transactions of Antennas and Propagation, Vol. AP-33, No. 12, pp. 1347-1353 (1985) (hereinafter "Non-Patent Document No. 2"). Non-Patent Document No. 2 discloses a basic structure of a scanned antenna having a spiral slot arrangement. The entire disclosures of Patent Document Nos. 1 to 4 and Non-Patent Document Nos. 1 and 2 are herein incorporated by reference.

Figure 1:
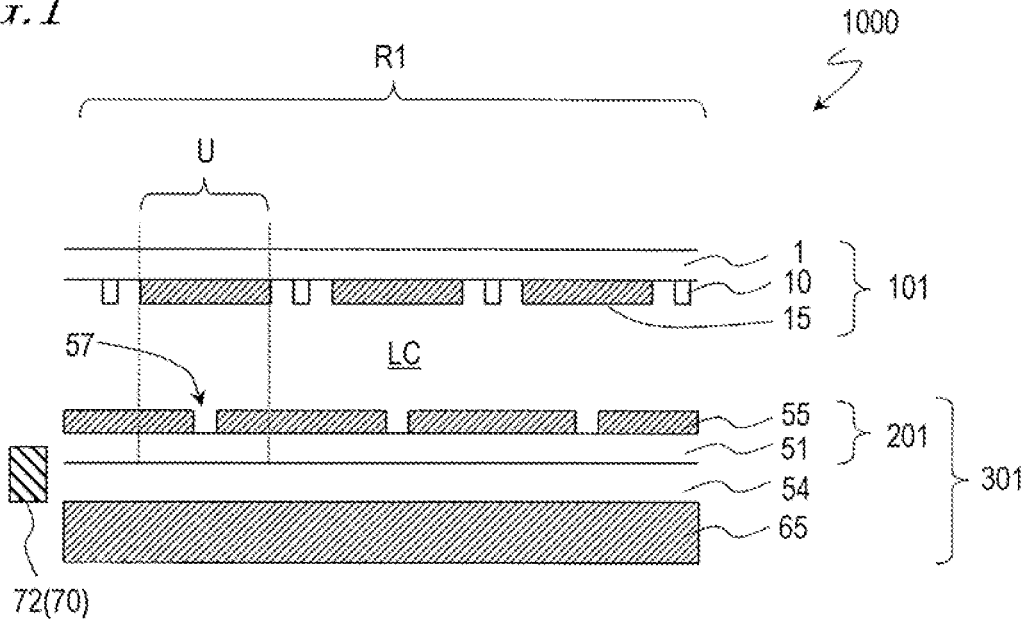
FIG. 1 is a cross-sectional view schematically showing a portion of a scanned antenna 1000.

Note that although antenna elements of a scanned antenna are similar to pixels of an LCD panel, the structure of an antenna element is different from that of a pixel of an LCD panel, and the arrangement of antenna elements is different from the arrangement of pixels of in an LCD panel. Referring to FIG. 1, which shows a scanned antenna 1000 described in Patent Document No. 6, the basic structure of a scanned antenna will be described. While the scanned antenna 1000 is a radial inline slot antenna including slots arranged in a concentric arrangement, the scanned antenna according to the embodiment of the present invention is not limited thereto, and the arrangement of slots may be any of various arrangements known in the art, for example. Particularly, for the arrangement of slots and/or antenna elements, the disclosure of Patent Document No. 5 is herein incorporated by reference.

FIG. 1 is a cross-sectional view schematically showing a portion of the scanned antenna 1000, schematically showing a portion of a cross section extending in the radial direction from a power feed pin 72 (see FIG. 2B) provided at around the center of slots arranged in a concentric arrangement.

The scanned antenna 1000 includes a TFT substrate 101, a slot substrate 201, a liquid crystal layer LC arranged therebetween, and a reflective conductive plate 65 arranged so as to oppose the slot substrate 201 with an air layer 54 interposed therebetween. The scanned antenna 1000 transmits/receives microwaves from the TFT substrate 101 side.

The TFT substrate 101 includes a dielectric substrate 1, such as a glass substrate, and a plurality of patch electrodes 15 and a plurality of TFTs 10 formed on the dielectric substrate 1. The patch electrodes 15 are connected to the corresponding TFTs 10. Each TFT 10 is connected to a gate bus line and a source bus line.

The slot substrate 201 includes a dielectric substrate 51, such as a glass substrate, and a slot electrode 55 formed on the liquid crystal layer LC side of the dielectric substrate 51. The slot electrode 55 includes a plurality of slots 57.

The reflective conductive plate 65 is arranged so as to oppose the slot substrate 201 with the air layer 54 interposed therebetween. A layer formed by a dielectric (e.g., a fluororesin such as PTFE) having a small dielectric constant M for microwaves can be used instead of the air layer 54. The slot electrode 55, the reflective conductive plate 65, and the dielectric substrate 51 and the air layer 54 therebetween together function as a waveguide 301.

The patch electrode 15, a portion of the slot electrode 55 including the slot 57, and the liquid crystal layer LC therebetween together form the antenna element U. In each antenna element U, one patch electrode 15 opposes a portion of the slot electrode 55 including one slot 57 with the liquid crystal layer LC interposed therebetween, thereby forming a liquid crystal capacitor. The structure in which the patch electrode 15 opposes the slot electrode 55 with the liquid crystal layer LC interposed therebetween is similar to the structure of an LCD panel in which the pixel electrode opposes the counter electrode with the liquid crystal layer interposed therebetween. That is, an antenna element U of the scanned antenna 1000 has a similar structure to that of a pixel of an LCD panel. An antenna element has a similar structure to that of a pixel of an LCD panel also in that it includes a storage capacitor electrically connected in parallel to a liquid crystal capacitor. However, the scanned antenna 1000 has many differences from the LCD panel.

First, the capacity required for the dielectric substrates 1 and 51 of the scanned antenna 1000 is different from that required for substrates of an LCD panel.

Typically, an LCD panel uses substrates that are transparent to visible light, e.g., a glass substrate or a plastic substrate. In a reflective-type LCD panel, the substrate on the back side needs no transparency, and therefore a semiconductor substrate may be used. In contrast, the dielectric substrates 1 and 51 of an antenna preferably have a small dielectric loss for microwaves (the dielectric loss tangent for microwaves will be denoted as tan $\delta_M$). Tan $\delta_M$ of the dielectric substrates 1 and 51 is preferably about 0.03 or less, and more preferably 0.01 or less. Specifically, a glass substrate or a plastic substrate may be used. A glass substrate has a better dimensional stability and a better heat resistance than a plastic substrate, and it is suitable for cases in which circuit elements such as TFTs, lines and electrodes are formed by using the LCD technology. For example, when the materials forming the waveguide are the air and a glass, it is preferably 400 μm or less and more preferably 300 μm or less since a glass has a greater dielectric loss and the waveguide loss can be reduced as the glass is thinner. There is no particular lower limit as long as it can be handled without being cracked during the manufacturing process.

The conductive material used for the electrode also varies. An ITO film is often used as the transparent conductive film for the pixel electrode and the counter electrode of an LCD panel. However, ITO has a large tan $\delta_M$ for microwaves, and it cannot be used as the conductive layer in an antenna. The slot electrode 55 functions as a wall of the waveguide 301, together with the reflective conductive plate 65. Therefore, in order to suppress the transmission of microwaves through the wall of the waveguide 301, the thickness of the wall of the waveguide 301, i.e., the thickness of the metal layer (a Cu layer or an Al layer), is preferably large. It is known in the art that the electromagnetic wave is attenuated to 1/20 (−26 dB) when the thickness of the metal layer is three times the skin depth, and the electromagnetic wave is attenuated to about 1/150 (−43 dB) when it is five times the skin depth. Therefore, it is possible to reduce the transmittance of electromagnetic waves to 1% if the thickness of the metal layer is five times the skin depth. For 10 GHz microwaves, for example, it is possible to reduce the microwaves to 1/150 by using a Cu layer whose thickness is 3.3 μm or more and an Al layer whose thickness is 4.0 μm or more. For 30 GHz microwaves, it is possible to reduce the microwaves to 1/150 by using a Cu layer whose thickness is 1.9 μm or more and an Al layer whose thickness is 2.3 μm or more. Thus, the slot electrode 55 is preferably formed from a Cu layer or an Al layer which is relatively thick. There is no particular upper limit to the thickness of the Cu layer or the Al layer, and the thickness may be set appropriately in view of the deposition time and cost. Using a Cu layer gives an advantage that it can be made thinner than when an Al layer is used. For the formation of a Cu layer or an Al layer which is relatively thick, it is possible to employ not only the thin film deposition method used in LCD manufacturing processes, but also other methods such as attaching a Cu foil or an Al foil to the substrate. The thickness of the metal layer is 2 μm or more and 30 μm or less, for example. When it is formed by using the thin film deposition method, the thickness of the metal layer is preferably 5 μm or less. Note that the reflective conductive plate 65 may be an aluminum plate, a copper plate, or the like, having a thickness of some mm, for example.

The patch electrode 15 may be a Cu layer or an Al layer whose thickness is smaller than the slot electrode 55 because it does not form the waveguide 301 as does the slot electrode 55. Note however that in order to avoid a loss that transforms into heat when the oscillation of free electrons near slots 57 of the slot electrode 55 is induced into the oscillation of free electrons in the patch electrode 15, it is preferred that the resistance is low. In view of mass production, it is preferred to use an Al layer rather than a CU layer, and the thickness of the Al layer is preferably 0.3 μm or more and 2 μm or less, for example.

The pitch with which the antenna elements U are arranged is significantly different from the pixel pitch. For example, for an antenna for 12 GHz (Ku band) microwaves, the wavelength λ is 25 mm, for example. Then, as described in Patent Document No. 4, the pitch of the antenna elements U is λ/4 or less and/or λ/5 or less, i.e., 6.25 mm or less and/or 5 mm or less. This is 10 times or more the pitch of the pixels of an LCD panel. Thus, the length and the width of the antenna elements U are about 10 times those of the pixel lengths of an LCD panel.

It is understood that the arrangement of the antenna elements U may be different from the arrangement of pixels in an LCD panel. An example of a concentric arrangement (see, for example, Japanese Laid-Open Patent Publication No. 2002-217640) will be illustrated herein, but the arrangement is not limited thereto, and it may be a spiral arrangement as described in Non-Patent Document No. 2, for example. Moreover, it may be a matrix arrangement as described in Patent Document No. 4.

Characteristics required for the liquid crystal material of the liquid crystal layer LC of the scanned antenna 1000 are different from those required for the liquid crystal material of an LCD panel. An LCD panel produces display by giving a phase difference to the polarization of visible light (wavelength 380 nm to 830 nm) by changing the refractive index of the liquid crystal layer of each pixel, thereby changing the polarization thereof (e.g., rotating the polarization axis direction of linearly-polarized light or changing the degree of circular polarization of circularly-polarized light). In contrast, the scanned antenna 1000 varies the phase of the microwave to be driven (re-radiated) from each patch electrode by changing the static capacitance value of the liquid crystal capacitor of the antenna element U. Therefore, with a liquid crystal layer, the anisotropy ($\Delta\varepsilon_M$) of the dielectric constant M($\varepsilon_M$) for microwaves is preferably large, and tan $\delta_M$ is preferably small. For example, one whose $\Delta\varepsilon_M$ is 4 or more and whose tan $\delta_M$ is 0.02 or less (each being a value for 9 Gz) described in M. Wittek et al., SID 2015 DIGEST, pp. 824-826 can suitably be used. In addition, a liquid crystal material whose $\Delta\varepsilon_M$ is 0.4 or more and whose tan $\delta_M$ is 0.04 or less described in Kuki, Polymer, vol. 55, August issue, pp. 599-602 (2006) can be used.

Typically, the dielectric constant of a liquid crystal material has a frequency dispersion, and the dielectric anisotropy $\Delta\varepsilon_M$ for microwaves has a positive correlation with the refractive index anisotropy Δn for visible light. Therefore, it can be said that a liquid crystal material of an antenna element for microwaves is preferably a material having a large refractive index anisotropy Δn for visible light. The refractive index anisotropy Δn of a liquid crystal material for an LCD is evaluated by the refractive index anisotropy for light of 550 nm. Also using Δn (birefringence) for light of 550 nm herein as the index, a nematic liquid crystal whose Δn is 0.3 or more, preferably 0.4 or more, can be used for an antenna element for microwaves. There is no particular upper limit to Δn. Note however that a liquid crystal material having a large Δn tends to have a strong polarity, and may possibly lower the reliability. The thickness of the liquid crystal layer is 1 μm to 500 μm, for example.

The structure of a scanned antenna will now be described in detail.

First, reference will be made to FIG. 1 and FIGS. 2A and 2B. FIG. 1 is a schematic partial cross-sectional view at around the center of the scanned antenna 1000 as described in detail above, and FIGS. 2A and 2B are schematic plan views showing the TFT substrate 101 and the slot substrate 201, respectively, of the scanned antenna 1000.

The scanned antenna 1000 includes a plurality of antenna elements U arranged in a two-dimensional arrangement, and the scanned antenna 1000 illustrated herein includes a plurality of antenna elements arranged in a concentric arrangement. In the following description, the region of the TFT substrate 101 or the slot substrate 201 corresponding to the antenna element U will be referred to as an "antenna element region" and will be denoted by the same reference sign U as the antenna element. As shown in FIGS. 2A and 2B, in the TFT substrate 101 and the slot substrate 201, a region defined by a plurality of antenna element regions arranged in a two-dimensional arrangement will be referred to as a "transmitting/receiving region R1", and regions other than the transmitting/receiving region R1 will be referred to as "non-transmitting/receiving regions R2". A terminal portion, a driving circuit, etc., are provided in the non-transmitting/receiving regions R2.

Figure 2A:
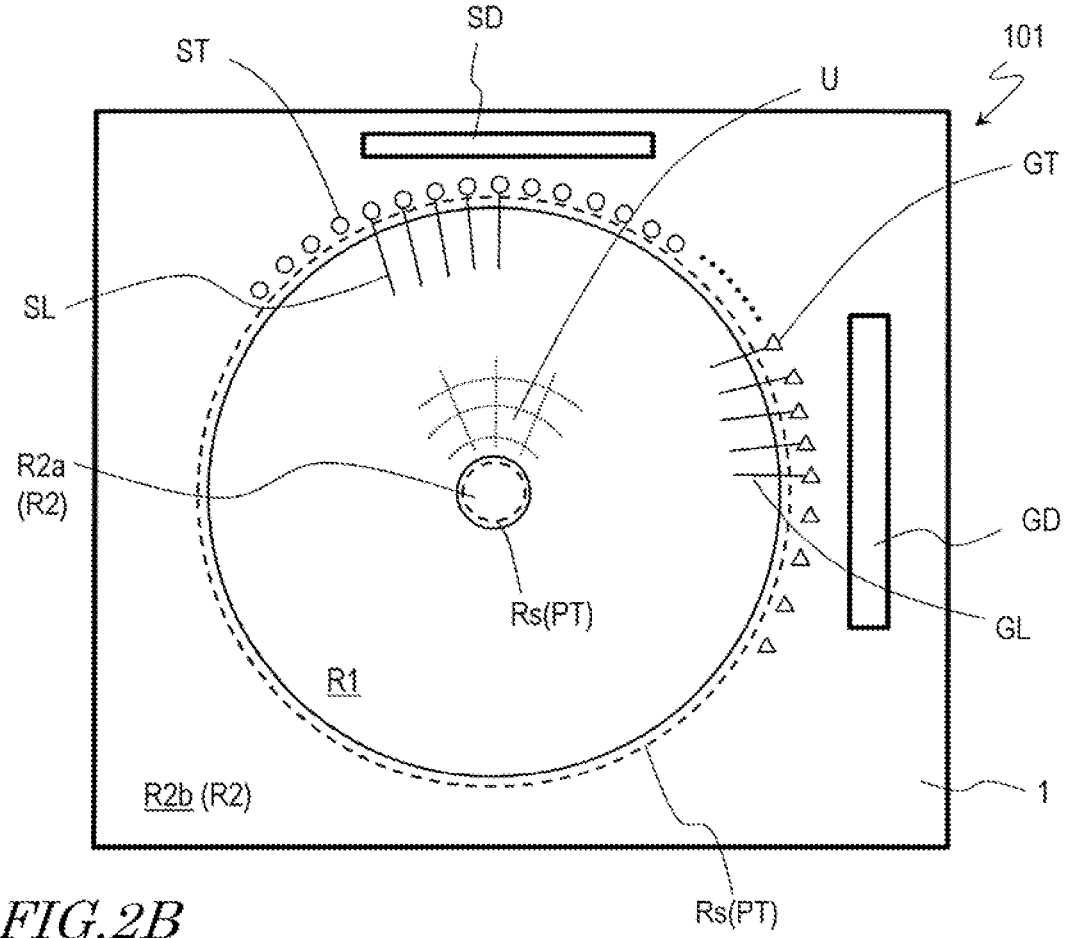
FIG. 2A is a schematic plan view showing a TFT substrate 101 of the scanned antenna 1000.
Figure 2B:
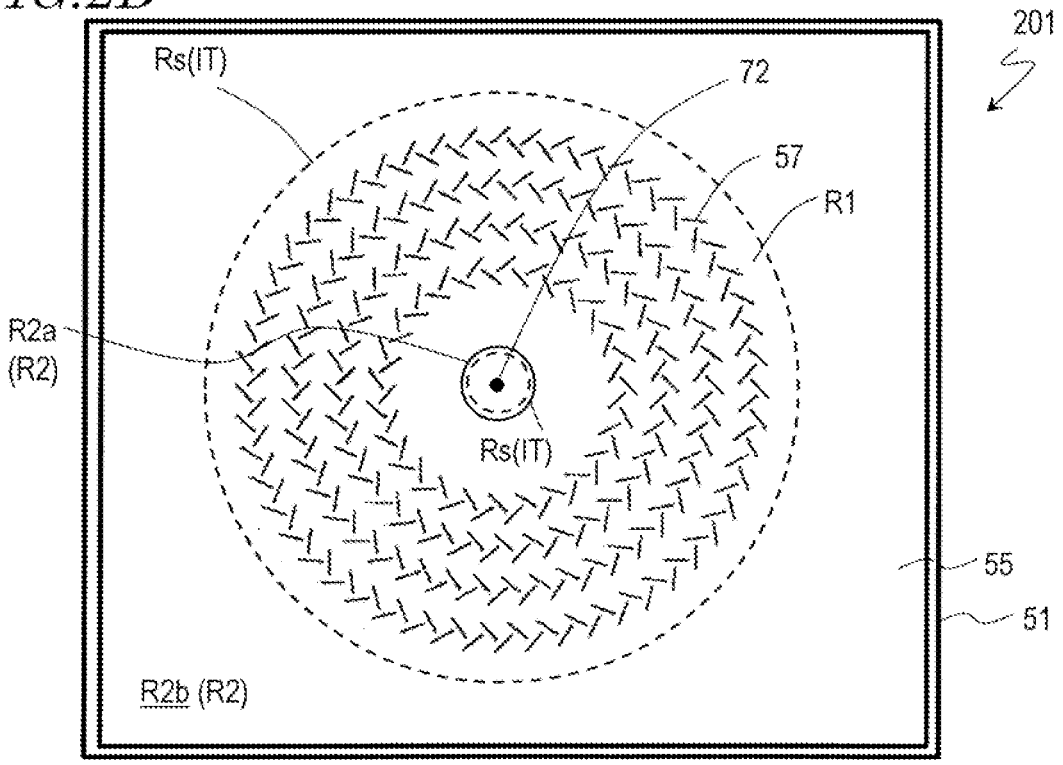
FIG. 2B is a schematic plan view showing a slot substrate 201 of the scanned antenna 1000.

FIG. 2A is a schematic plan view showing the TFT substrate 101 of the scanned antenna 1000.

In the illustrated example, as seen from the direction normal to the TFT substrate 101, the transmitting/receiving region R1 is donut-shaped. The non-transmitting/receiving regions R2 include a first non-transmitting/receiving region R2*a* located at the center portion of the transmitting/receiving region R1 and a second non-transmitting/receiving region R2*b* located at the peripheral portion of the transmitting/receiving region R1. The outer diameter of the transmitting/receiving region R1 is 200 mm to 1500 mm, for example, and may be set based on the traffic volume, or the like.

The transmitting/receiving region R1 of the TFT substrate 101 includes a plurality of gate bus lines GL and a plurality of source bus lines SL supported on the dielectric substrate 1, and the antenna element regions U are defined by these lines. The antenna element regions U are arranged in a concentric arrangement, for example, in the transmitting/receiving region R1. Each of the antenna element regions U includes a TFT, and a patch electrode electrically connected to the TFT. The source electrode of a TFT and the gate electrode thereof are electrically connected to a source bus line SL and the gate bus line GL, respectively. The drain electrode is electrically connected to the patch electrode.

A seal region Rs is arranged in the non-transmitting/receiving region R2 (R2*a*, R2*b*) so as to surround the transmitting/receiving region R1. A sealant (not shown) is provided in the seal region Rs. The sealant bonds together the TFT substrate 101 and the slot substrate 201, and also seals the liquid crystal between these substrates 101 and 201.

The gate terminal portion GT, the gate driver GD, the source terminal portion ST and the source driver SD are provided in the non-transmitting/receiving region R2 outside the seal region Rs. The gate bus lines GL are connected to the gate driver GD via the gate terminal portions GT. The source bus lines SL are connected to the source driver SD via the source terminal portions ST. Note that although the source driver SD and the gate driver GD are formed on the dielectric substrate 1 in this example, one or both of these drivers may be provided on another dielectric substrate.

A plurality of transfer terminal portions PT are also provided in the non-transmitting/receiving region R2. The transfer terminal portions PT are electrically connected to the slot electrode 55 of the slot substrate 201 (FIG. 2B). In the present specification, the connecting portion between the transfer terminal portion PT and the slot electrode 55 will be referred to as a "transfer portion". As shown in the figure, the transfer terminal portions PT (transfer portions) may be arranged in the seal region Rs. In this case, a resin containing conductive particles therein may be used as the sealant. Thus, it is possible to seal the liquid crystal between the TFT substrate 101 and the slot substrate 201, and to ensure an electrical connection between the transfer terminal portion PT and the slot electrode 55 of the slot substrate 201. Although the transfer terminal portions PT are arranged both in the first non-transmitting/receiving region R2*a* and in the second non-transmitting/receiving region R2*b* in this example, the transfer terminal portions PT may be arranged either one of these regions.

Note that the transfer terminal portions PT (transfer portions) may not be arranged in the seal region Rs. For example, they may be arranged outside the seal region Rs in the non-transmitting/receiving region R2.

FIG. 2B is a schematic plan view illustrating the slot substrate 201 of the scanned antenna 1000, showing the liquid crystal layer LC side surface of the slot substrate 201.

On the slot substrate 201, the slot electrode 55 is formed on the dielectric substrate 51 across the transmitting/receiving region R1 and the non-transmitting/receiving region R2.

A plurality of slots 57 are arranged in the slot electrode 55 in the transmitting/receiving region R1 of the slot substrate 201. The slots 57 are arranged so as to correspond to the antenna element regions U on the TFT substrate 101. In the illustrated example, pairs of slots 57 are arranged in a concentric arrangement, each pair including slots 57 extending in directions generally orthogonal to each other so as to implement a radial inline slot antenna. Having slots generally orthogonal to each other, the scanned antenna 1000 is capable of transmitting/receiving circularly-polarized waves.

A plurality of terminal portions IT of the slot electrode 55 are provided in the non-transmitting/receiving region R2. The terminal portions IT are electrically connected to the transfer terminal portions PT of the TFT substrate 101 (FIG. 2A). In this example, the terminal portions IT are arranged in the seal region Re, and are electrically connected to the corresponding transfer terminal portions PT by a sealant containing conductive particles therein.

In the first non-transmitting/receiving region R2*a*, the power feed pin 72 is arranged on the reverse side of the slot substrate 201. With the power feed pin 72, microwaves are inserted into the waveguide 301 formed by the slot electrode 55, the reflective conductive plate 65 and the dielectric substrate 51. The power feed pin 72 is connected to a power feed device 70. The power is fed from the center of the concentric arrangement in which the slots 57 are arranged. The power feeding method may be either a direct power feed method or an electromagnetic coupling method, and a power feed structure known in the art can be employed.

In FIGS. 2A and 2B, the seal region Rs is shown to be provided so as to surround a relatively small region that includes the transmitting/receiving region R1, but the present invention is not limited to this. Particularly, the seal region Rs, which is provided outside the transmitting/receiving region R1, may be provided in the vicinity of the sides of the dielectric substrate 1 and/or the dielectric substrate 51, for example, so that the distance from the transmitting/receiving region R1 is equal to a predetermined distance or more. Needless to say, a terminal portion and a driving circuit, for example, provided in the non-transmitting/receiving region R2, may be formed outside the seal region Rs (i.e., on the side where the liquid crystal layer is absent). By locating the seal region Rs with a predetermined distance or more from the transmitting/receiving region R1, it is possible to suppress the lowering of the antenna property due to an influence from an impurity (particularly, an ionic impurity) included in a sealant (particularly, a curable resin).

With the scanned antenna 1000 described in Patent Document No. 6, all of the antenna elements U are driven by the gate driver GD and the source driver SD. Therefore, when used for transmission/reception, it was necessary that the scanned antenna 1000 be driven in a time-division manner. For example, when performing transmission with right-hand circularly-polarized waves and reception with left-hand circularly-polarized waves, or when using different frequencies for transmission and for reception, it was necessary that the antenna elements U be composed of two groups, e.g., a plurality of first antenna elements (first group) and a plurality of second antenna elements (second group), and that it be driven (driven in a time-division manner) so as to drive the first antenna elements (first group) in certain periods and the second antenna elements (second group) in other periods. Slots are arranged in the first antenna elements and in the second antenna elements in accordance with their polarizations and/or frequencies. The region where the first antenna elements are arranged and the region where the second antenna elements are arranged overlap each other. For example, the first antenna elements and the second antenna elements are both arranged with a predetermined interval therebetween substantially across the entirety of the transmitting/receiving region R1.

Figure 3:
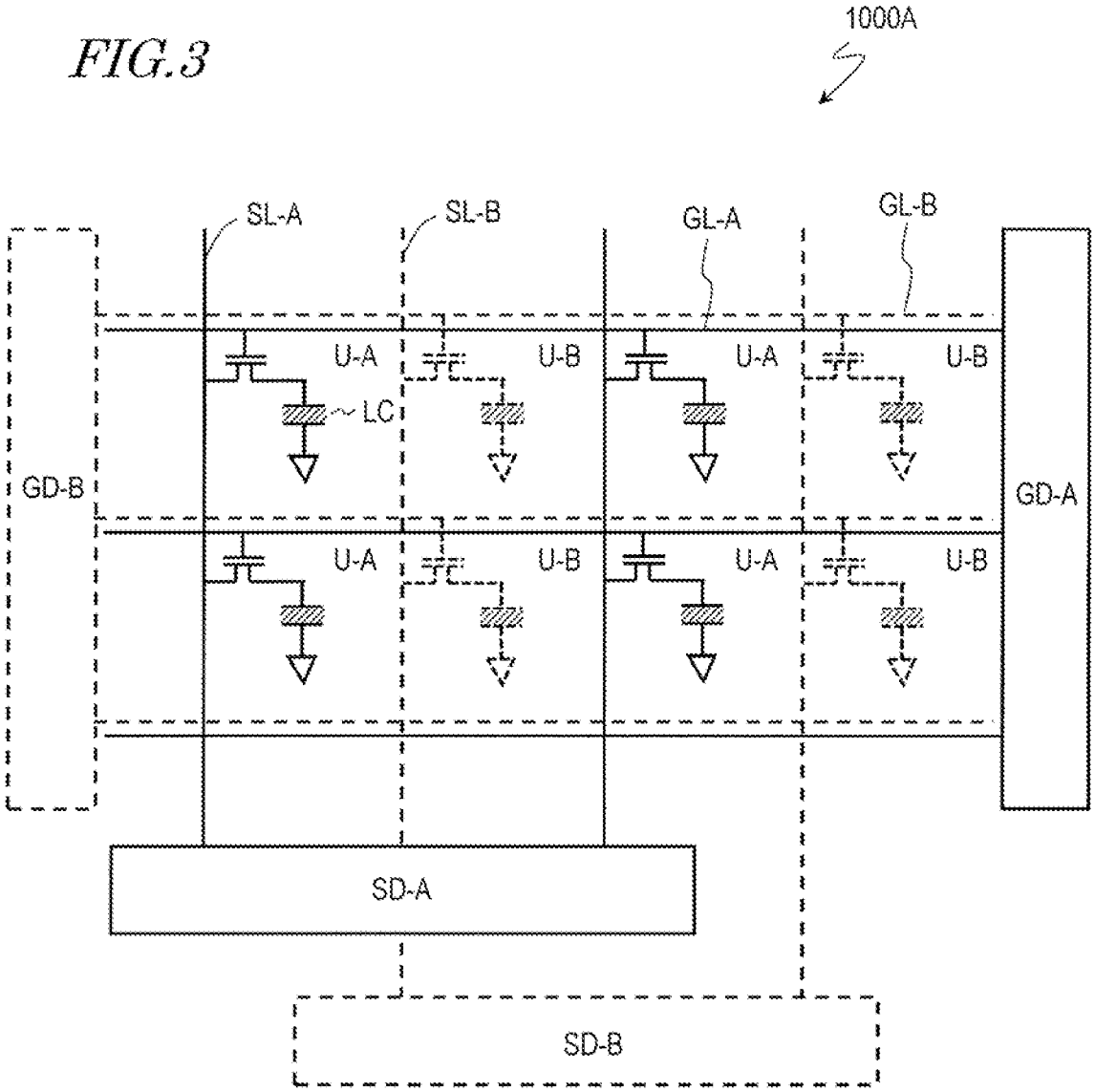
FIG. 3 is a schematic circuit diagram showing a scanned antenna 1000A according to Embodiment 1 of the present invention.

FIG. 3 shows a schematic circuit diagram of a scanned antenna 1000A according to Embodiment 1 of the present invention. Note that FIG. 3 shows a portion of the scanned antenna 1000A, and the arrangement of antenna elements U-A and U-B is merely illustrative. This similarly applies to the subsequent figures.

As shown in FIG. 3, the scanned antenna 1000A includes a plurality of first antenna elements U-A and a plurality of second antenna elements U-B. The first antenna elements U-A are driven by a gate driver GD-A connected to a plurality of first gate bus lines GL-A and a first source driver SD-A connected to a plurality of first source bus lines SL-A. The second antenna elements U-B is driven by a gate driver GD-B connected to a plurality of second gate bus lines GL-B and a second source driver SD-B connected to a plurality of second source bus lines SL-B. The gate driver GD-A and the gate driver GD-B operate independently of each other, and the first source driver SD-A and the second source driver SD-B operate independently of each other.

Herein, the first antenna elements U-A and the second antenna elements U-B are arranged so that the source bus line SL-A and the source bus line SL-B, to which the first antenna elements U-A and the second antenna elements U-B are connected respectively, alternate with each other along gate bus lines. The first antenna elements U-A and the second antenna elements U-B are each arranged with a predetermined interval, and transmit or receive radio waves of a predetermined polarization and/or a predetermined frequency.

Since the gate driver GD-A and the gate driver GD-B operate independently of each other and the first source driver SD-A and the second source driver SD-B operate independently of each other, it is possible for example to drive the first antenna elements U-A at a first driving frequency (e.g., 90 Hz) and to drive the second antenna elements U-B at a second driving frequency (e.g., 120 Hz) that is different from the first driving frequency. For example, the first antenna elements U-A may be used for reception and the second antenna elements U-B for transmission. It is understood that the transmission frequency and the reception frequency may be different from each other.

Figure 4:
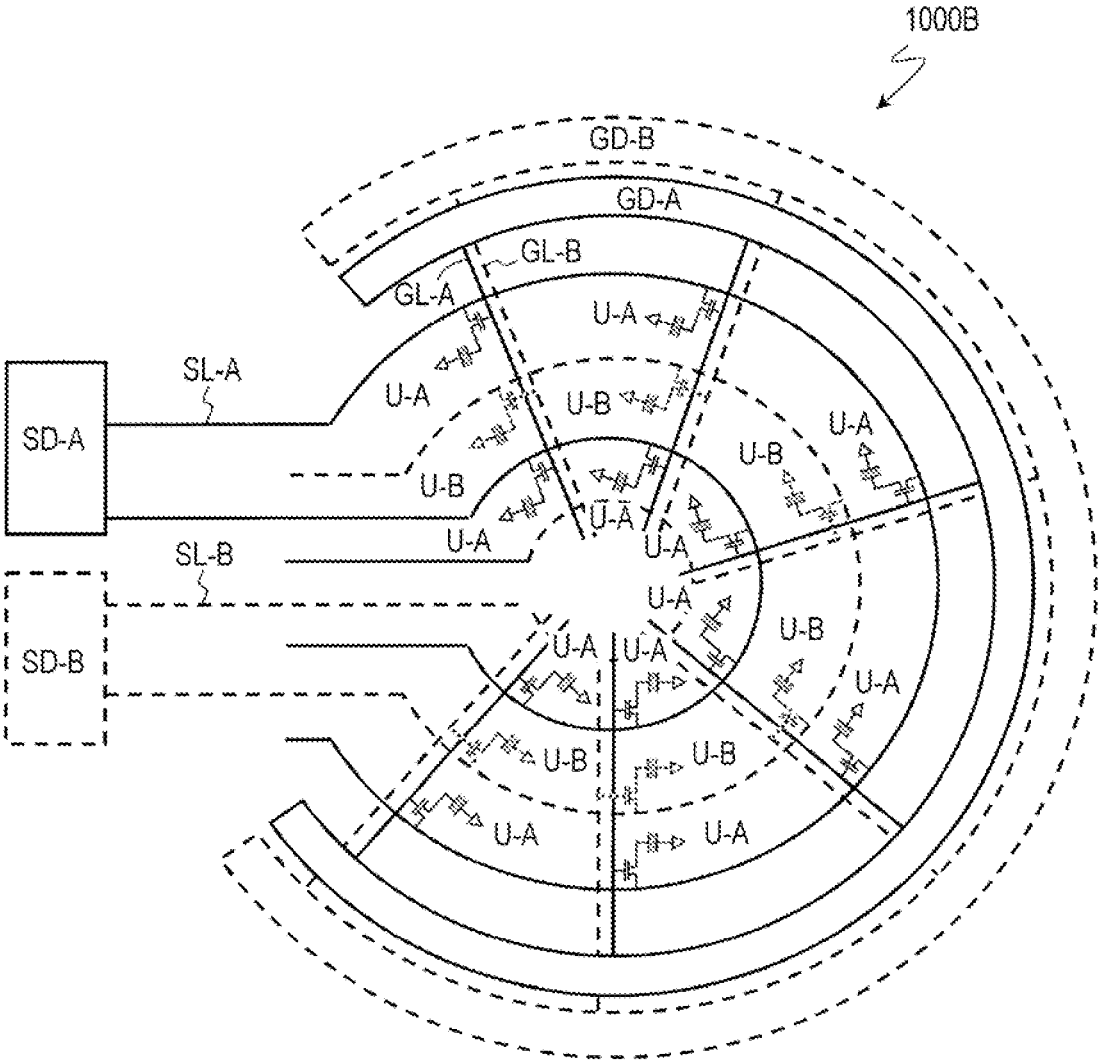
FIG. 4 is a schematic circuit diagram showing another scanned antenna 1000B according to Embodiment 1 of the present invention.

FIG. 4 shows a schematic circuit diagram of another scanned antenna 1000B according to Embodiment 1. As shown in FIG. 4, the first antenna elements U-A and the second antenna elements U-B of the scanned antenna 1000B are arranged in a concentric arrangement. The source bus lines SL-A and the source bus lines SL-B extending along the circumference alternate with each other in the radial direction, and the gate bus lines GL-A and the gate bus lines GL-B extending in the radial direction alternate with each other in the circumferential direction.

Also with the scanned antenna 1000B, as with the scanned antenna 1000A, the first antenna elements U-A are driven by the gate driver GD-A connected to the first gate bus lines GL-A and the first source driver SD-A connected to the first source bus lines SL-A. The second antenna elements U-B are driven by the gate driver GD-B connected to the second gate bus lines GL-B and the second source driver SD-B connected to the second source bus lines SL-B. The gate driver GD-A and the gate driver GD-B operate independently of each other, the first source driver SD-A and the second source driver SD-B operate independently of each other, and the first antenna elements U-A and the second antenna elements U-B are driven independently.

Figure 5:
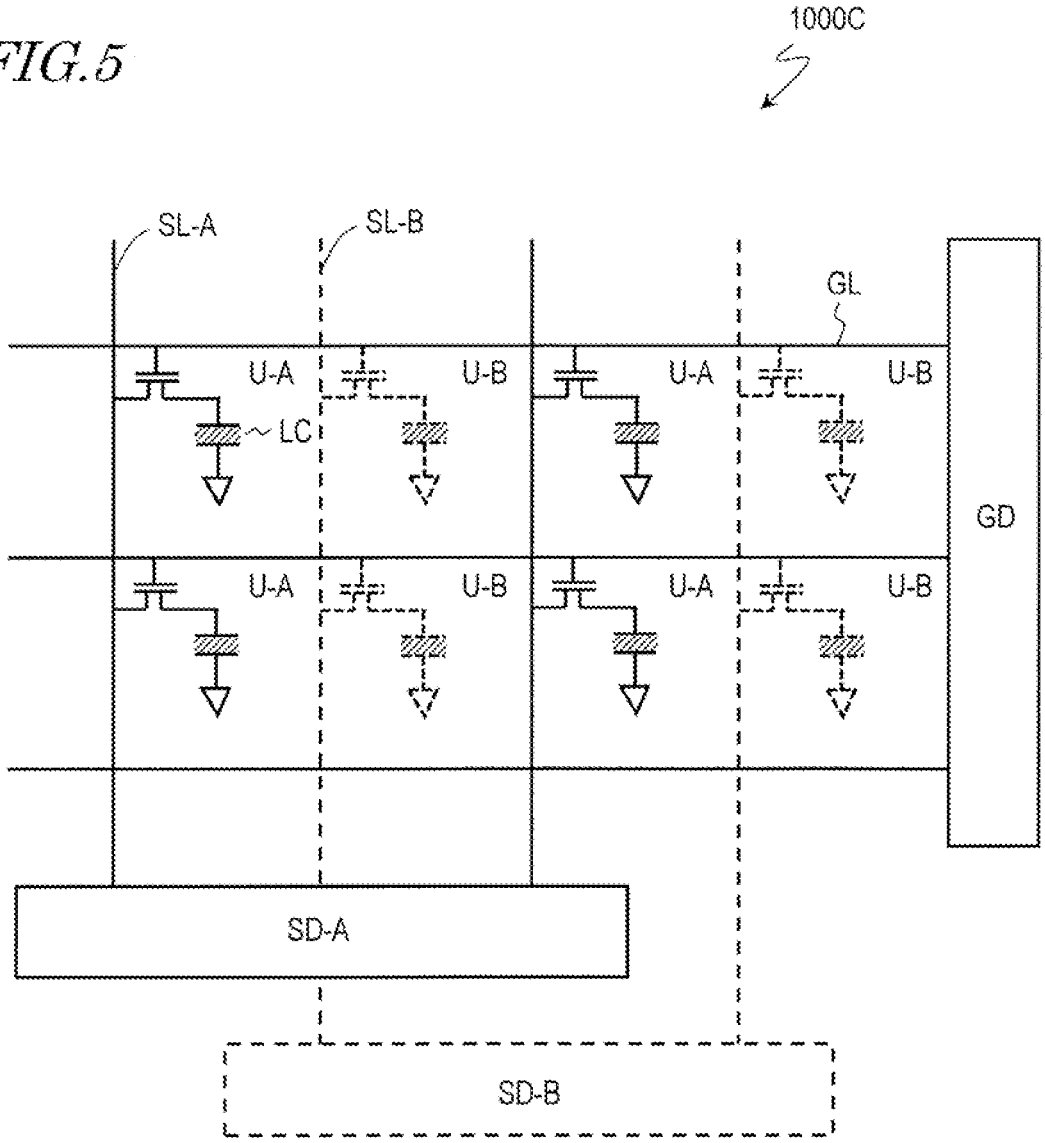
FIG. 5 is a schematic circuit diagram showing a scanned antenna 1000C according to Embodiment 2 of the present invention.

FIG. 5 shows a schematic circuit diagram of a scanned antenna 1000C according to Embodiment 2 of the present invention. As do the scanned antennas 1000A and 1000B of Embodiment 1, the scanned antenna 1000C also includes a plurality of first antenna elements U-A and a plurality of second antenna elements U-B. It is different from the scanned antennas 1000A and 1000B of Embodiment 1 in that the first antenna elements U-A and the second antenna elements U-B are driven by a common gate driver GD connected to a plurality of gate bus lines GL.

The first antenna elements U-A are driven by the gate driver GD and the first source driver SD-A connected to a plurality of first source bus lines SL-A. The second antenna elements U-B are driven by the gate driver GD and the second source driver SD-B connected to a plurality of second source bus lines SL-B. The first source driver SD-A and the second source driver SD-B operate independently of each other. Therefore, when different source voltages (data voltages) are used for driving the first antenna elements U-A and for driving the second antenna elements U-B, source drivers suitable for the respective voltage ranges can be employed.

Figure 6:
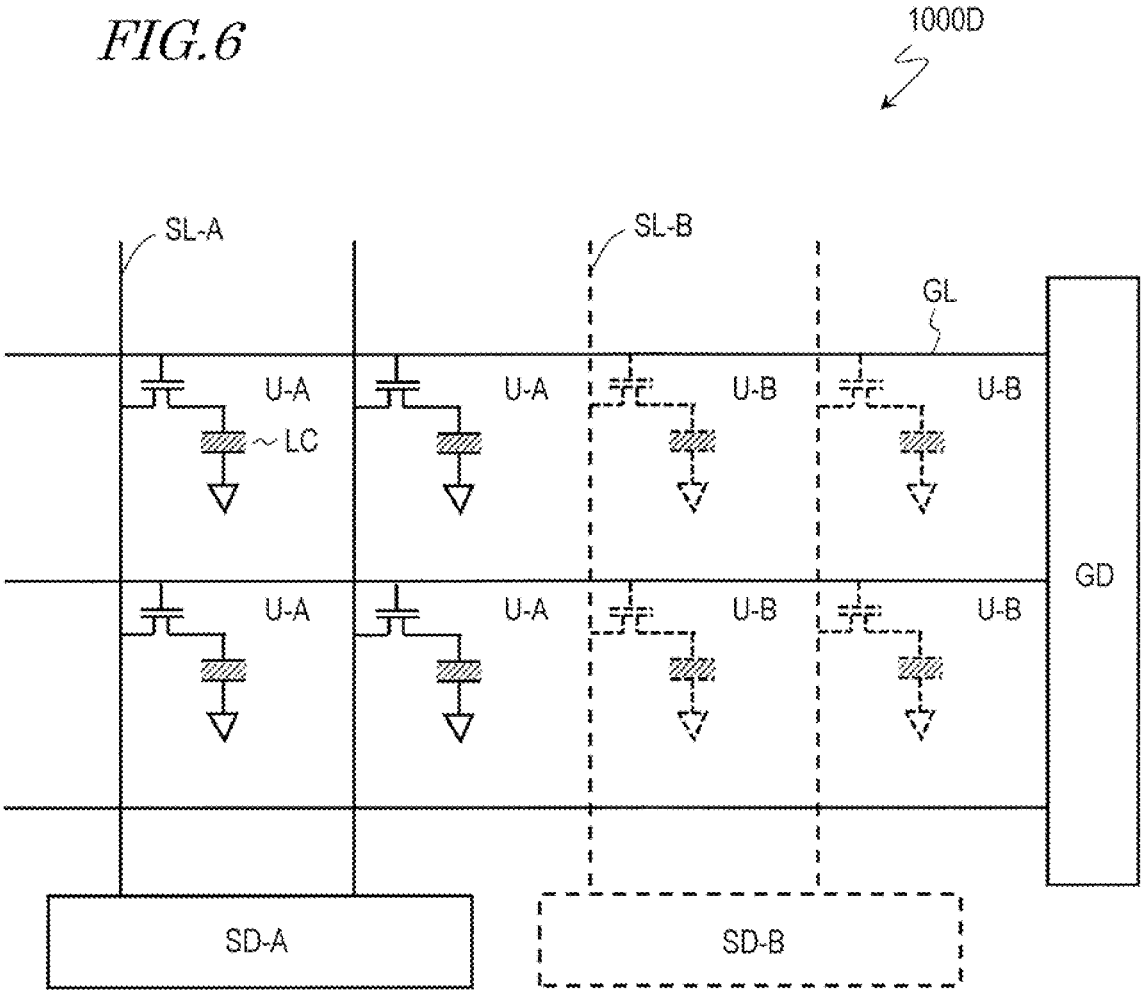
FIG. 6 is a schematic circuit diagram showing another scanned antenna 1000D according to Embodiment 2 of the present invention.

With the scanned antenna 1000C shown in FIG. 5, the first antenna elements U-A and the second antenna elements U-B are arranged so that the source bus lines SL-A and the source bus lines SL-B alternate with each other along gate bus lines. However, the present invention is not limited to this, and they may be arranged so that source bus lines SL-A connected to a plurality of first antenna elements U-A are adjacent to each other along gate bus lines and source bus lines SL-B connected to a plurality of second antenna elements U-B are adjacent to each other along gate bus lines, as the scanned antennas 1000D shown in FIG. 6, for example. The number of source bus lines SL-A or source bus lines SL-B adjacent to each other is not limited to two, but may be any other number.

Figure 7:
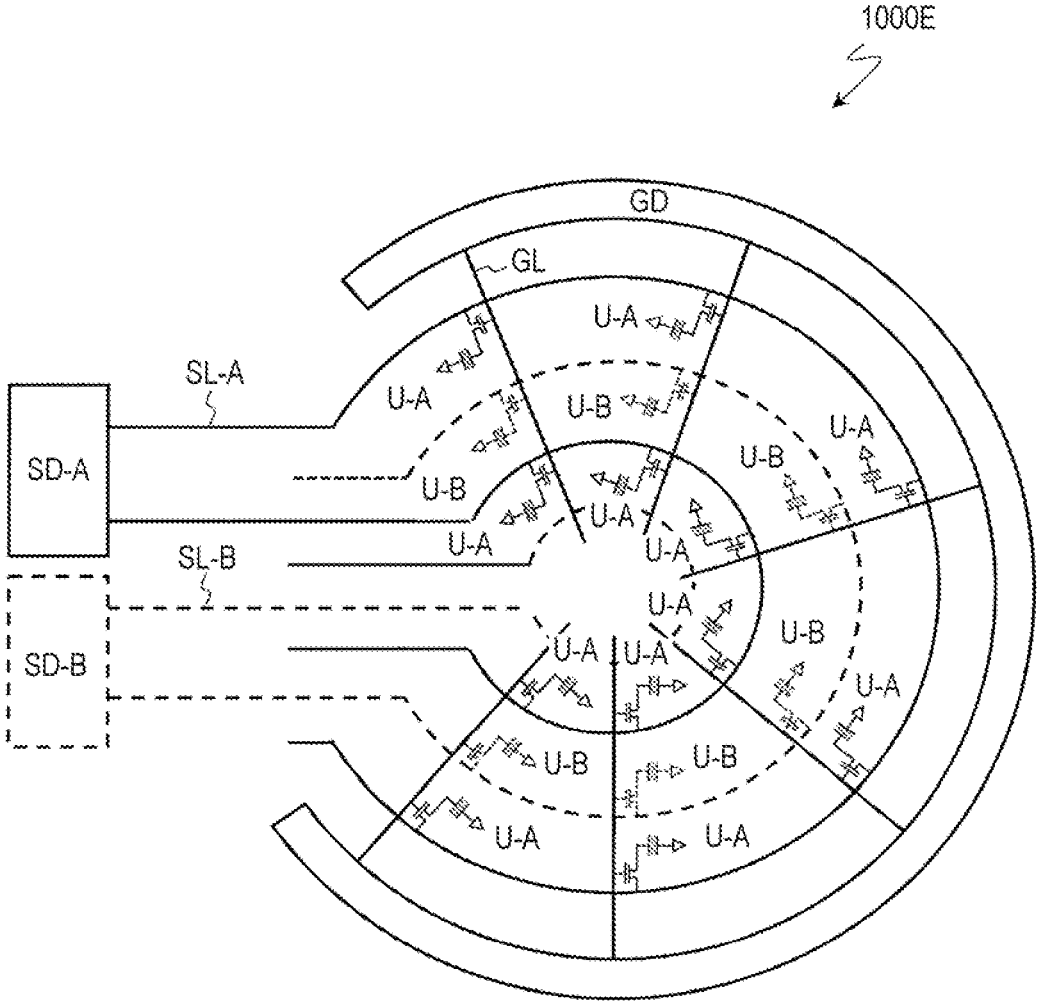
FIG. 7 is a schematic circuit diagram showing still another scanned antenna 1000E according to Embodiment 2 of the present invention.

FIG. 7 shows a schematic circuit diagram of another scanned antenna 1000E according to Embodiment 2. As shown in FIG. 7, the first antenna elements U-A and the second antenna elements U-B of the scanned antenna 1000E are arranged in a concentric arrangement. The source bus lines SL-A and the source bus lines SL-B extending along the circumference alternate with each other in the radial direction, and the gate bus lines GL connected to a plurality of first antenna elements U-A and a plurality of second antenna elements U-B extend in the radial direction. With the scanned antenna 1000E, as with the scanned antennas 1000C and 1000D, a plurality of first antenna elements U-A are driven by the gate driver GD and the first source driver SD-A, and a plurality of second antenna elements U-B are driven by the gate driver GD and the second source driver SD-B.

Figure 8:
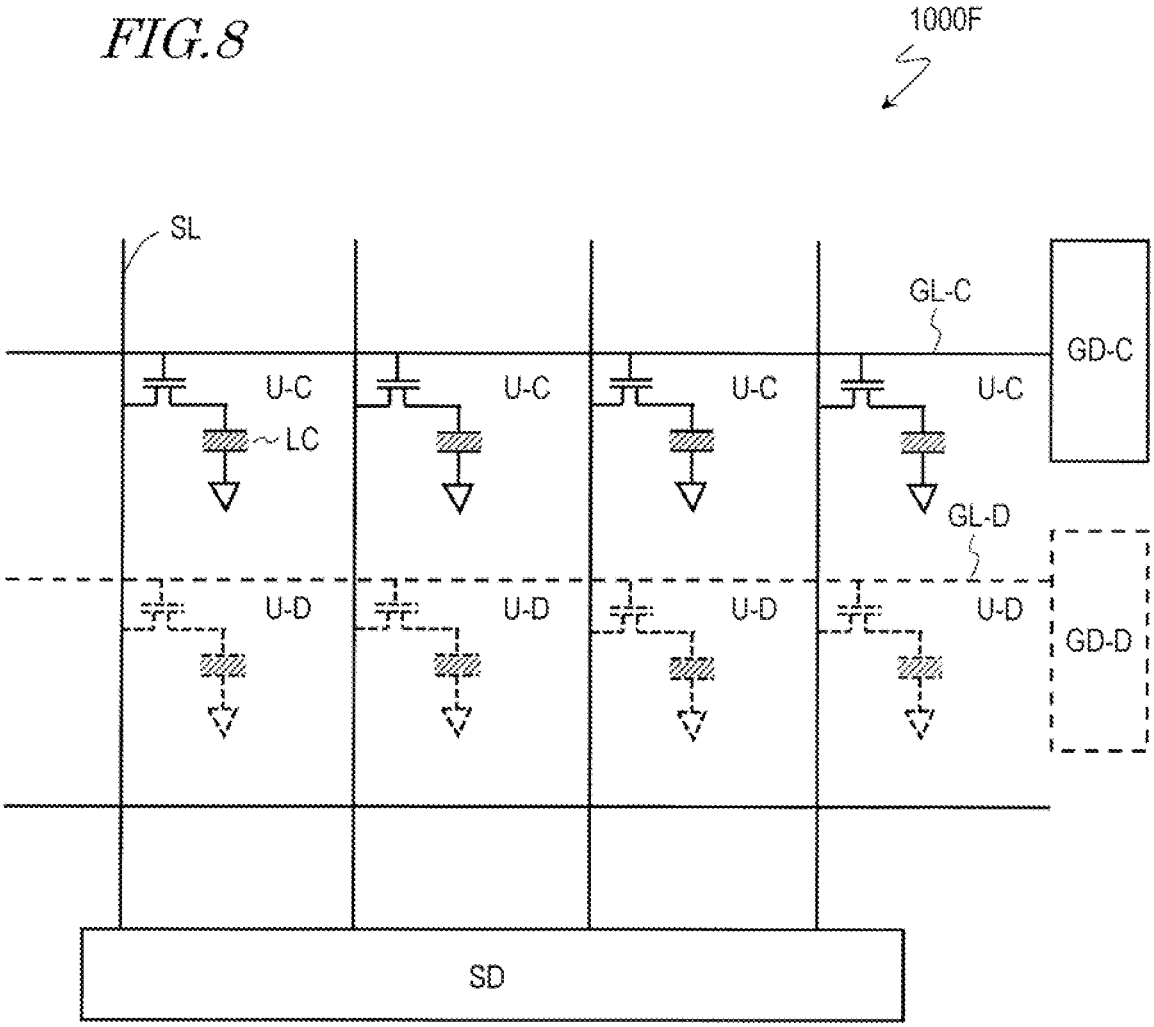
FIG. 8 is a schematic circuit diagram showing a scanned antenna 1000F according to Embodiment 3 of the present invention.

FIG. 8 shows a schematic circuit diagram of a scanned antenna 1000F according to Embodiment 3 of the present invention. As do the scanned antennas 1000A and 1000B of Embodiment 1, the scanned antenna 1000F also includes a plurality of first antenna elements U-C and a plurality of second antenna elements U-D. It is different from the scanned antennas 1000A and 1000B of Embodiment 1 in that a plurality of first antenna elements U-C and a plurality of second antenna elements U-D are driven by a common source driver SD connected to a plurality of source bus lines SL.

A plurality of first antenna elements U-C are driven by a gate driver GD-C and a source driver SD connected to a plurality of source bus lines SL. A plurality of second antenna elements U-D are driven by a gate driver GD-D and a source driver SD connected to a plurality of source bus lines SL. The gate driver GD-C and the gate driver GD-D operate independently of each other. Therefore, when TFTs of the first antenna elements U-C and TFTs of the second antenna elements U-D have different threshold characteristics from each other, gate drivers suitable for the respective threshold voltages can be employed.

Figure 9:
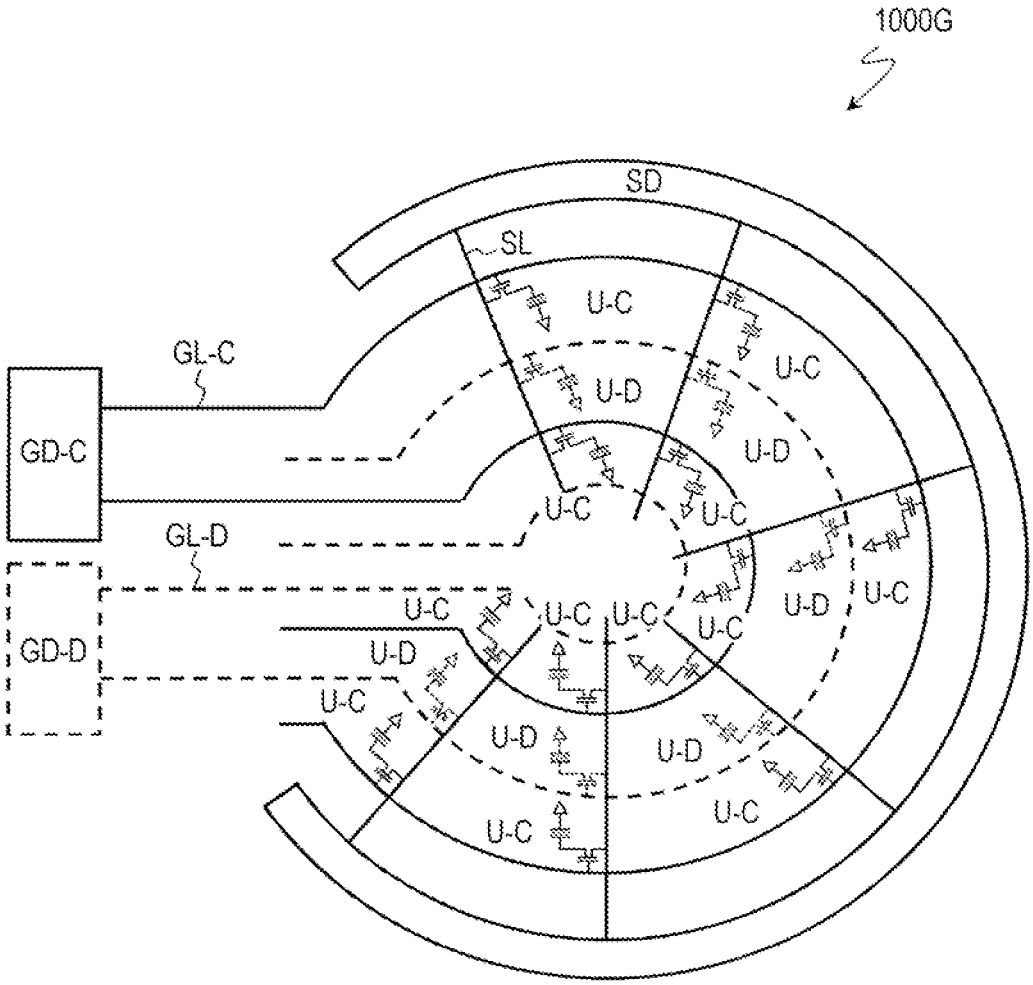
FIG. 9 is a schematic circuit diagram showing another scanned antenna 1000G according to Embodiment 3 of the present invention.

FIG. 9 shows a schematic circuit diagram of another scanned antenna 1000G according to Embodiment 3. As shown in FIG. 9, the first antenna elements U-C and the second antenna elements U-D of the scanned antenna 1000G are arranged in a concentric arrangement. The gate bus lines GL-C and the gate bus lines GL-D extending along the circumference alternate with each other in the radial direction, and the source bus lines SL connected to a plurality of first antenna elements U-C and a plurality of second antenna elements U-D extend in the radial direction. With the scanned antenna 1000G, as with the scanned antenna 1000F, a plurality of first antenna elements U-C are driven by the gate driver GD-C and the source driver SD, and a plurality of second antenna elements U-D are driven by the gate driver GD-D and the source driver SD.

While scanned antenna embodiments have been described above, the embodiments of the present invention are not limited to scanned antennas, but are widely applicable to liquid crystal devices configured so that voltages are applied, via TFTs, to liquid crystal elements each including a pair of electrodes and a liquid crystal layer arranged between the pair of electrodes, such as antenna elements of a scanned antenna or pixels of a liquid crystal display device.

That is, a liquid crystal device according to one embodiment of the present invention is a liquid crystal device including a plurality of liquid crystal elements arranged in an array, wherein each of the liquid crystal elements includes a first electrode, a second electrode and a liquid crystal layer provided between the first electrode and the second electrode, wherein the first electrode is connected to a source bus line via a TFT, and the TFT is connected to a gate bus line. The voltage to be supplied to the second electrode may be determined appropriately. For example, the second electrode may be a counter electrode shared by a plurality of liquid crystal elements. The liquid crystal elements include first liquid crystal elements and second liquid crystal elements; a TFT of each of the first liquid crystal elements is connected to the first source driver via a first source bus line; a TFT of each of the second liquid crystal elements is connected to a second source driver via a second source bus line; and the first source driver and the second source driver operate independently of each other. Then, when different source voltages (data voltages) are used for driving the first liquid crystal elements and for driving the second liquid crystal elements, as with the scanned antenna of Embodiment 2, source drivers suitable for the respective voltage ranges can be employed.

A liquid crystal device according to another embodiment of the present invention may be configured so that a TFT of each of the first liquid crystal elements is connected to a first gate driver via a first gate bus line; a TFT of each of the second liquid crystal elements is connected to a second gate driver via a second gate bus line; and the first gate driver and the second gate driver operate independently of each other. Then, as with the scanned antenna of Embodiment 3, when TFTs of the first liquid crystal elements and TFTs of the second liquid crystal elements have different threshold characteristics, gate drivers suitable for the respective threshold voltages can be employed.

It is understood that as with the scanned antenna of Embodiment 1, the first liquid crystal elements may be driven by a first gate driver connected to a plurality of first gate bus lines and a first source driver connected to a plurality of first source bus lines, and the second liquid crystal elements may be driven by a second gate driver connected to a plurality of second gate bus lines and a second source driver connected to a plurality of second source bus lines. Then, the first liquid crystal elements and the second liquid crystal elements can be driven independently (e.g., with different driving frequencies).

For example, the scanned antennas according to the embodiments of the present invention can be suitably used as scanned antennas for use in satellite communications or satellite broadcasting that are mounted on a vehicle (e.g., a ship, an aircraft, an automobile). The liquid crystal devices according to the embodiments of the present invention can be suitably used as liquid crystal display devices, and the like.

While the present invention has been described with respect to exemplary embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

This application is based on Japanese Patent Application No. 2017-213843 filed on Nov. 6, 2017, the entire content of which is hereby incorporated by reference.

What is claimed is:

1. A scanned antenna including a plurality of antenna elements arranged in an array, the scanned antenna comprising:

a TFT substrate including a first dielectric substrate, a plurality of TFTs supported on the first dielectric substrate, a plurality of gate bus lines, a plurality of source bus lines, and a plurality of patch electrodes;

a slot substrate including a second dielectric substrate, a slot electrode formed on a first primary surface of the second dielectric substrate, wherein the slot electrode includes a plurality of slots arranged so as to correspond to the patch electrodes;

a liquid crystal layer provided between the TFT substrate and the slot substrate; and a reflective conductive plate arranged so as to oppose a second primary surface of the second dielectric substrate opposite to the first primary surface with a dielectric layer therebetween, wherein:

the antenna elements include first antenna elements and second antenna elements;

the first antenna elements are driven by a first gate driver connected to a plurality of first gate bus lines and a first source driver connected to a plurality of first source bus lines;

the second antenna elements are driven by a second gate driver connected to a plurality of second gate bus lines and a second source driver connected to a plurality of second source bus lines; and the first gate driver and the second gate driver operate independently of each other, and the first source driver and the second source driver operate independently of each other.

2. The scanned antenna of claim 1, wherein:

the first gate driver and the first source driver drive the first antenna elements at a first driving frequency; and the second gate driver and the second source driver drive the second antenna elements at a second driving frequency that is different from the first driving frequency.

3. The scanned antenna of claim 1, wherein the first antenna elements are for reception, and the second antenna elements are for transmission.

4. The scanned antenna of claim 1, wherein the first antenna elements and the second antenna elements receive or transmit electromagnetic waves of different frequencies.

5. The scanned antenna of claim 1, wherein a region where the first antenna elements are arranged and a region where the second antenna elements are arranged overlap each other.

* * * * *